United States Patent [19]

Fukuo et al.

[11] Patent Number: 4,858,574

[45] Date of Patent: Aug. 22, 1989

[54] HYDRAULIC CIRCUIT FOR A VALVE OPERATING TIMING CONTROL DEVICE FOR AN INTERNAL COMBUSTION ENGINE

[75] Inventors: Koichi Fukuo; Mitsuhiro Shibata; Toshiaki Hiro; Masahiko Matsumoto, all of Saitama, Japan

[73] Assignee: Honda Giken Kogyo Kabushiki Kaisha, Tokyo, Japan

[21] Appl. No.: 138,080

[22] Filed: Dec. 24, 1987

[30] Foreign Application Priority Data

Dec. 26, 1986 [JP] Japan ..... 61-314801
Dec. 26, 1986 [JP] Japan ..... 61-314803

[51] Int. Cl.[4] ..... F01L 1/34; F01M 1/08; F01M 9/10

[52] U.S. Cl. ..... 123/90.34; 123/90.16; 123/90.17; 123/90.44

[58] Field of Search ..... 123/90.16, 90.17, 90.27, 123/90.33, 90.34, 90.36, 90.39, 90.43, 90.44, 90.46, 198 F

[56] References Cited

U.S. PATENT DOCUMENTS 3,628,513 12/1971 Grosseau ..... 123/90.34
3,782,357 1/1974 Kuhn et al. ..... 123/90.33 X
4,441,465 4/1984 Nakamura ..... 123/90.33 X
4,535,732 8/1985 Nakano et al. ..... 123/90.16
4,537,165 8/1985 Honda et al. ..... 123/90.16
4,644,912 2/1987 Umeha et al. ..... 123/90.34
4,656,977 4/1987 Nagahiro et al. ..... 123/90.16
4,709,667 12/1987 Ichihara et al. ..... 123/90.34

FOREIGN PATENT DOCUMENTS 0575263 5/1959 Canada ..... 123/90.33

*Primary Examiner*—Willis R. Wolfe
*Attorney, Agent, or Firm*—Lyon & Lyon

[57] ABSTRACT

A hydraulic circuit for a valve operation timing control device for an internal combustion engine which has a low-speed cam having a shape suited for low-speed operation of the engine, a high-speed cam having a shape suited for high-speed operation of the engine, the low- and high-speed cams being integrally formed on a camshaft rotatable in synchronism with a crankshaft, a first rocker arm held in slidable contact with the low-speed cam, a second rocker arm held in slidable contact with the high-speed cam. The first and second rocker arms are adjacent to and in slidable contact with each other and pivotably supported on a rocker shaft for relative angular displacement. There is a first oil feed passage for lubricating the low-speed cam and a second oil feed passage for lubricating the high-speed cam. The first rocker arm has a hydraulic lash adjuster and a relief valve is disposed in the oil passage for supplying oil pressure to said hydraulic lash adjuster for maintaining a predetermined oil pressure on the hydraulic lash adjuster.

17 Claims, 4 Drawing Sheets

HYDRAULIC CIRCUIT FOR A VALVE OPERATING TIMING CONTROL DEVICE FOR AN INTERNAL COMBUSTION ENGINE

The present invention relates to a hydraulic circuit for a valve operation timing control device capable of varying the operation timing of intake or exhaust valves of an internal combustion engine.

For controlling the output power of an internal combustion engine, it is known to vary the operation timing of the intake and exhaust valves in low- and high-speed operation modes of an engine for thereby increasing the efficiency of charging an air-fuel mixture into a combustion chamber over a wide engine operating range, as disclosed, for example, in U.S. Pat. Nos. 4,537,165, 4,537,164, 4,545,342, 4,535,732, 4,656,977, 4,612,884 4,576,128 and 4,587,937 assigned to the assignee of the subject application.

In such devices for controlling the valve operation timing, the interior space of a rocker shaft is used as an oil passage, and there are a rocker arm slidably held against a low-speed cam having a cam profile suited for low- and medium-speed operation of the engine and another rocker arm relatively displaceably held in slidable contact with the first rocker arm and slidable held against a high-speed cam having a cam profile suited for high-speed operation of the engine. These rocker arms are selectively connected and disconnected under the pressure of working oil supplied from the engine for varying the operation timing of valves. Another oil feed passage is provided for sufficiently lubricating the low- and high-speed cams during the low- and medium-speed operation of the engine or the high-speed operation of the engine.

It is also well known to provide a hydraulic lash adjuster housed in the free end of a rocker arm held against an intake or exhaust valve for eliminating valve clearance at all times regardless of changes in engine temperature thereby to reduce noise and allow the valve to follow the movement of the rocker arm precisely in a wide speed range from low to high speeds. The hydraulic lash adjuster is operated under oil pressure fed from the engine. In order to stabilize the operation of the hydraulic lash adjuster, it is known to have a relief valve disposed in an oil passage leading from the engine to the hydraulic lash adjuster for controlling the working oil pressure for the hydraulic lash adjuster. Lubricating oil that leaks from the relief valve as a result of excessive pressure is discharged onto the top of the cylinder head and returns back to the oil tank.

Where such a hydraulic lash adjuster is incorporated in the valve operation timing control device of the type described above, lubricating oil supplied from the engine is used for connecting and disconnecting the rocker arms, lubricating the low-speed cams and the high-speed cam, and operating the hydraulic lash adjuster. The amount of lubricating oil retained in the engine is substantially constant, and the displacement of an oil pump for feeding the lubricating oil under pressure is limited. Therefore, it is necessary to utilize the lubricating oil most effectively for economical reasons in order to provide a sufficient supply of oil and oil pressure for all the oil feed systems.

It is an object of the present invention to provide a novel and simple oil supply system for effectively and efficiently meeting the oil supply requirements of the valve operating mechanism.

It is another object of the present invention to provide a hydraulic circuit for a valve operation timing control device having hydraulic lash adjusters, which utilizes lubricating oil supplied from a pump in an engine most effectively as a sufficient supply of oil pressure for the respective oil feed systems, for achieving stable working oil pressure and for sufficient lubrication.

According to one embodiment of the present invention, the above objects can be accomplished by a hydraulic circuit for a valve operation timing control device for an internal combustion engine, wherein oil pressure in applied from one end of an oil passage defined in a rocker shaft on which rocker arms are pivotally supported wherein the oil passage extends to actuators disposed in the rocker arms for opening an intake valve or an exhaust valve that are normally urged in a valve closing direction, which rocker arms are angularly movable by cams rotatable in synchronism with a crankshaft and the other end of the oil passage communicates with an open end through an orifice.

According to another embodiment of the present invention, the above objects can be accomplished by a hydraulic circuit for a valve operation timing control device for an internal combustion engine, having a low-speed cam having a shape suited for low-speed operation of the engine, a high-speed cam having a shape suited for high-speed operation of the engine, the low- and high-speed cams being integrally formed on a cam shaft rotatable in synchronism with a crankshaft, a first rocker arm held in slidable contact with said low-speed cam, a second rocker arm held in slidable contact with said high-speed cam, said first and second rocker arms being held in slidable contact with each other and swingably supported on a rocker shaft for relative angular displacement, a first oil feed passage for lubricating said low-speed cam, and a second oil feed passage for lubricating said high-speed cam, characterized in that said first rocker arm has a hydraulic lash adjuster, a relief valve is disposed in an oil passage for supplying oil pressure to said hydraulic lash adjuster, said relief valve has an outlet communicating with at least one of said first and second oil feed passages.

With the aforesaid arrangement, the pressure of working oil supplied to the hydraulic lash adjuster housed in the first rocker arm is stably controlled, and lubricating oil under excessive pressure cam be effectively utilized for lubricating the cams.

Three embodiments of the present invention will hereinafter be described with reference to the accompanying drawings, wherein.

Figure 1:
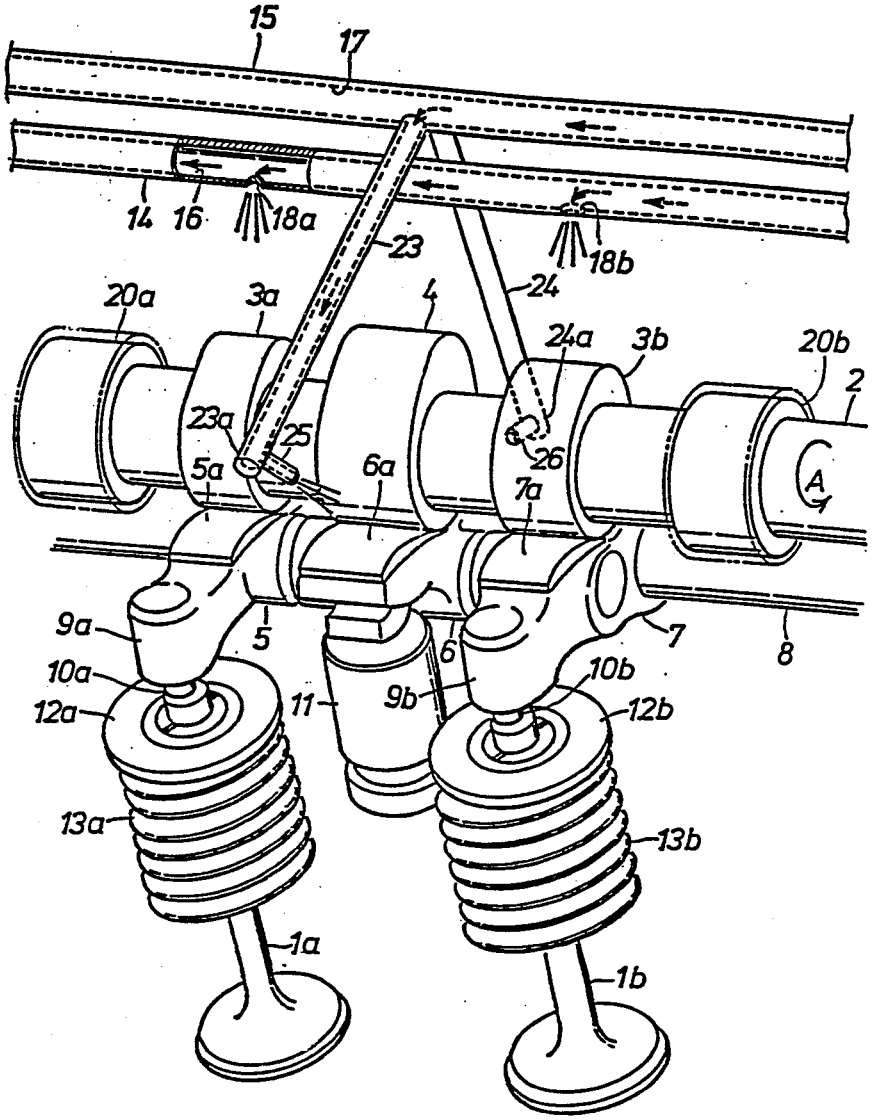
FIG. 1 is a perspective view of a valve operating mechanism for an internal combustion engine to which the principles of the present invention are applicable.

FIG. 1 shows a valve operating mechanism for an internal combustion engine, in which any one of the hydraulic circuits of the present invention may be incorporated. The valve operating mechanism varies the operation timing of valves in low- and medium-speed ranges and a high-speed range of the engine. A pair of intake valves 1*a*, 1*b* mounted in an engine body (not shown) can be opened and closed by the coaction of a pair of low-speed cams 3*a*, 3*b* and a single high-speed cam 4 which are of egg-shaped cross section and are integrally formed on a camshaft 2 that is synchronously rotatable at a speed ratio of ½ the speed or rotation of a crankshaft (not shown), and first through third rocker arms 5, 6, 7 serving as cam followers swingable in engagement with the cams 3*a*, 3*b*, 4. The internal combustion engine also has a pair of exhaust valves (not shown) which may be opened and closed in the same manner as the intake valves 1*a*, 1*b* or in any other conventional manner.

The first through third adjacent rocker arms 5, 6, 7 are pivotally supported on a rocker shaft 8 fixedly disposed parallel to and below a camshaft 2. The first and third rocker arms 5, 7 are basically identical in shape to each other and have base ends pivotally supported on the rocker shaft 8 and free ends extending over intake valves 1*a*, 1*b*, respectively. The rocker arms 5, 7 have respective free ends 9*a*, 9*b* housing therein hydraulic lash adjusters having lower ends 10*a*, 10*b*, respectively, held against the upper ends of the respective intake valves 1*a*, 1*b*. The hydraulic lash adjusters are known devices operable under oil pressure supplied from an engine oil pump through an oil passage defined in the rocker shaft 8.

The second rocker arm 6 is pivotally supported on the rocker shaft 8 between the first and third rocker arms 5, 7 and extends toward a position between the intake valves 1*a*, 1*b*. The second rocker arm 6 has defined on its upper surface a cam slipper 6*a* held in slidable contact with a high-speed cam 4. A lost-motion spring device 11 has an upper end abutting against the lower end of the second rocker arm 6. The lost-motion spring device 11 houses a coil spring therein for normally urging the second rocker arm 6 upwardly to keep the high-speed cam 4 and the cam slipper 6*a* in slidable contact with each other at all times.

The camshaft 2 is rotatably mounted above the engine body. The camshaft 2 has the low-speed cams 3*a*, 3*b* of a cam profile having a relatively small lift suitable for low-speed operation of the engine. The low-speed cams 3*a*, 3*b* are integrally formed on the camshaft 2. The high-speed cam 4 is also integrally formed on the camshaft 2 and has a cam profile having a lift suitable for high-speed operation of the engine and having a larger angular extent than the low-speed cams 3*a*, 3*b*. The low-speed cams 3*a*, 3*b* have outer peripheral surfaces held in slidable contact with respective cam slippers 5*a*, 7*a* on the upper surfaces of the first and third rocker arms 5, 7. The first through third rocker arms 5, 6, 7 are angularly movable, dependent on the rotational speed of the engine, between a position in which they are swingable in unison and a position in which they are relatively angularly movable by a coupling device mounted in holes defined centrally in the first through third rocker arms 5, 6, 7 parallel to the rocker shaft 8.

Retainers 12*a*, 12*b* are attached to upper portions of the intake valves 1*a*, 1*b*, respectively. Valve springs 13*a*, 13*b* are disposed between the retainers 12*a*, 12*b* and the engine body around the stems of the intake valves 1*a*, 1*b* for normally urging the intake valves 1*a*, 1*b*, respectively, in a valve closing direction.

Above the camshaft 2, there are disposed an oil feed pipe 14 for the low-speed cams 3*a*, 3*b* and an oil feed pipe 15 for the high-speed cam 4. The oil feed pipes 14, 15 have oil passages 16, 17 defined therein for supplying lubricating oil from the engine. The oil feed pipe 14 has ejector holes 18*a*, 18*b* defined in its peripheral wall and opening above the low-speed cams 3*a*, 3*b*, respectively. Lubricating oil supplied through the coil passage 16 is showered through the ejector holes 18*a*, 18*b* onto the low-speed cams 3*a*, 3*b*.

The other oil feed pipe 15 is connected to two branch pipes 23, 24 extending perpendicularly to the axis of the oil feed pipe 15. The branch pipes 23, 24 have free ends 23*a*, 24*a* positioned one on each side of the high-speed cam 4 and facing the mutually sliding surfaces of the cam 4 and the cam slipper 6*a*. A nozzle 25 is attached to the free end 23*a* of the branch pipe 23 and opens toward the mutually sliding surfaces of the cam 4 and the cam slipper 6*a*. The nozzle 25 ejects lubricating oil from a front side of the cam 4 in the same direction as the direction, indicated by the arrow A, in which the cam 4 rotates. Likewise, a nozzle 26 is attached to the free end 24*a* of the branch pipe 24 and opens toward the mutually sliding surfaces of the cam 4 and the cam slipper 6*a* from the outer side thereof. The nozzle 26 ejects lubricating oil from a rear side of the cam 4 in the opposite direction to the direction A of rotation of the cam 4.

Figure 2:
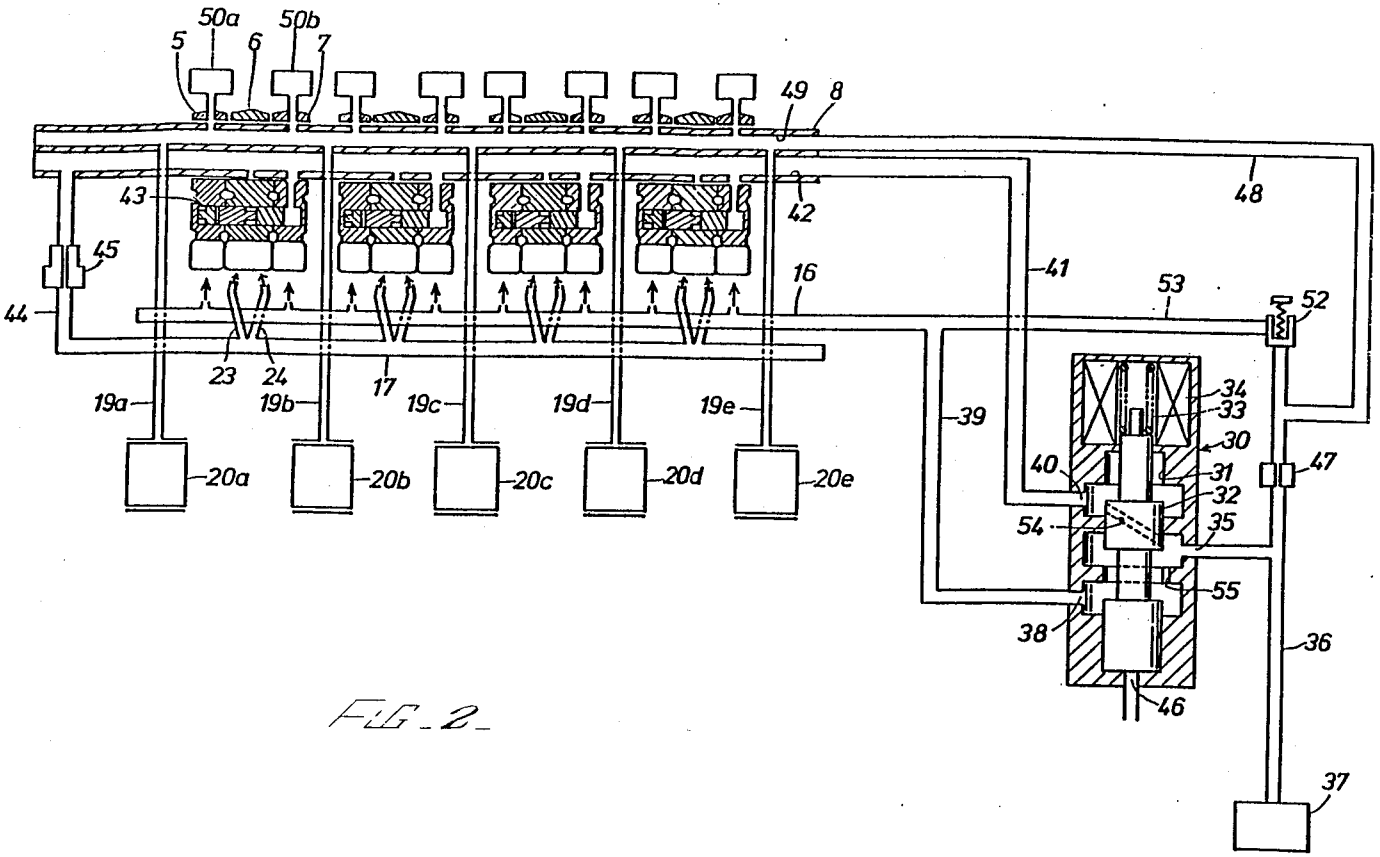
FIG. 2 is a diagram of a first embodiment of the hydraulic circuit of the present invention.

FIG. 2 schematically shows a hydraulic circuit incorporated in a valve operating timing control device for a four-cylinder internal combustion engine having a valve operating mechanism as shown in FIG. 1. A solenoid-operated valve 30 includes a spool 32 slidably disposed in a guide hole 31 and normally biased to the illustrated position by a spring 33. When the solenoid 34 is energized, the spool 32 is attracted upwardly. A first port 35 is an inlet for working oil pressure and communicates with an oil pump 37 of the engine through an oil passage 36. A second port 38 is held in communication via an oil passage 39 with the oil passage 16 which supplies oil to the low-speed cams 3*a*, 3*b*. a third port 40 communicates via an oil passage 41 with an oil passage 42 defined in the rocker shaft 8 for supplying oil pressure to coupling devices 43 comprising hydraulic actuators disposed in the rocker arms and for lubricating the bearing surface pivotally supporting the second rocker arms 6. The oil passage 42 has an end connected to an oil passage 44 having an orifice 45 and communicating with the oil passage 17 which supplies oil to the high-speed cams 4. A drain hole 46 is defined in the bottom of the guide hole 31 for draining lubricating oil that leaks from the gap between the spool 32 and the wall of the guide hole 31 onto the cylinder head (not shown) without trapping the lubricating oil in the guide hole 31.

The oil passage 36 is branched off upstream of the solenoid-operated valve 30 and communicates through an orifice 47 and an oil passage 48 to another oil passage 49 defined in the rocker shaft 8. The oil passage 49 supplies oil to hydraulic lash adjusters 50*a*, 50*b* in the first and third rocker arms 5, 7, respectively, associated with each of the engine cylinders. The oil passage 49 also supplies oil through passages 19*a* through 19*e* to lubricate journals 20*a* through 20*e* integrally formed on the camshaft 2 for rotatably supporting the camshaft 2. The oil passage 48 has a relief valve 52 having an outlet communicating via an oil passage 53 with the oil passage 16.

Operation of the hydraulic circuit of this first embodiment of the present embodiment will now be described. During low- and medium-speed operation of the engine, the spool 32 is in the illustrated position. Therefore, the first port 35 and the second port 38 are held in communication with each other to supply lubricating oil from the engine via the oil passage 39 into the oil passage 16 for thereby lubricating the low-speed cams 3*a*, 3*b*. The spool 32 gas a first leak passage 54 through which the first port 35 and the third port 40 communicate with each other in the illustrated position. Therefore, part of the lubricating oil delivered from the pump 37 flows through the oil passage 41 into the oil passage 42 in the rocker shaft 8. The lubricating oil supplied to the oil passage 42 is restricted by the orifice 45 when it flows into the oil passage 44 and then into the oil passage 17 for the lubrication of the high-speed cams 4 and the cam slippers 6*a*. Therefore, even during the low- and medium-speed operation of the engine, a small amount of flow of lubricating oil is developed in the oil passage 42 in the rocker shaft 8.

During high-speed operation of the engine, the spool 32 is attracted upwardly by the solenoid 34 to bring the first port 35 into communication with the third port 40. Therefore, lubricating oil supplied from the pump 37 mainly goes into the oil passage 42 in the rocker shaft 8. The actuators 43 are now operated to interconnect the first through third rocker arms 5, 6, 7 for varying the operation timing of the valves. The actuators 43 are known as disclosed in the eight U.S. patents identified at the start of this application. The lubricating oil supplied to the oil passage 42 flows into the oil passage 17, with its flow rate being regulated by the orifice 45, and is ejected through the branch pipes 23, 24 to lubricate the high-speed cams 4 and the cam slippers 6*a*.

The solenoid-operated valve 30 has a second leak passage 55 for communicating the first and second ports 35, 38 with each other when the valve 30 is actuated. Thus, part of the lubricating oil flows from the first port 35 to the second port 38 even in the shifted spool position, and is supplied via the oil passage 39 into the oil passage 16 for thereby lubricating the low-speed cams 3*a*, 3*b* and the cam slippers 5*a*, 7*a*.

In the above-embodiment, the lubricating oil flowing from the end of the oil passage 42 through the orifice 45 is used only to lubricate the high-speed cams 4 and the cam slippers 6*a*. However, this lubricating oil may also be used to lubricate the low-speed cams 3*a*, 3*b* and the journals.

Part of the lubricating oil supplied under pressure from the oil pump 37 through the oil passage 36 flows through the oil passages 48, 498 to the hydraulic lash adjusters 50*a*, 50*b*, while its flow rate is regulated by the orifice 47. The oil pressure acting on the hydraulic lash adjusters 50*a*, 50*b* is kept at a substantially constant level by the relief valve 52. When the oil pressure from the engine exceeds a certain level, for example, during high-speed operation of the engine, the relief valve 52 is opened to release part of the oil pressure into the oil passage 53 coupled to the outlet of the relief valve 52. The lubricating oil flowing into the oil passage 53 is added to the lubricating oil supplied via the oil passage 39 and then fed into the oil passage 16 for the lubrication of the low-speed cams 5, 7.

In the aforesaid embodiment, the oil passage 53 is connected only to the oil passage 16 for lubricating the low-speed cams. However, the oil passage 53 may be connected to the oil passage 17 for lubricating the high-speed cam. Alternatively, the oil passage 53 may be connected to both the oil passage 16 and the oil passage 17.

With the present invention, as described above in connection with the first embodiment of FIG. 1, the relief valve is disposed in the oil passage leading from the engine to the hydraulic lash adjusters in the low-speed rocker arms for controlling the pressure of working oil to stabilize the operation of the hydraulic lash adjusters. The outlet of the relief valve is held in communication with the oil passage for lubricating the low-speed cams or the high-speed cam to employ lubricating oil released from the relief valve to lubricate the cams. The constant amount of lubricating oil retained in the engine can therefore be utilized to a maximum degree for stabilizing the working oil pressure and sufficiently lubricating the cams. During high-speed operation of the engine, especially, the rocker arms are held in slidable contact with the base circle portions of the low-speed cams under certain pressure. Consequently, the arrangement of the invention is highly advantageous for improving the durability of the cams and cam follower slippers.

Figure 3:
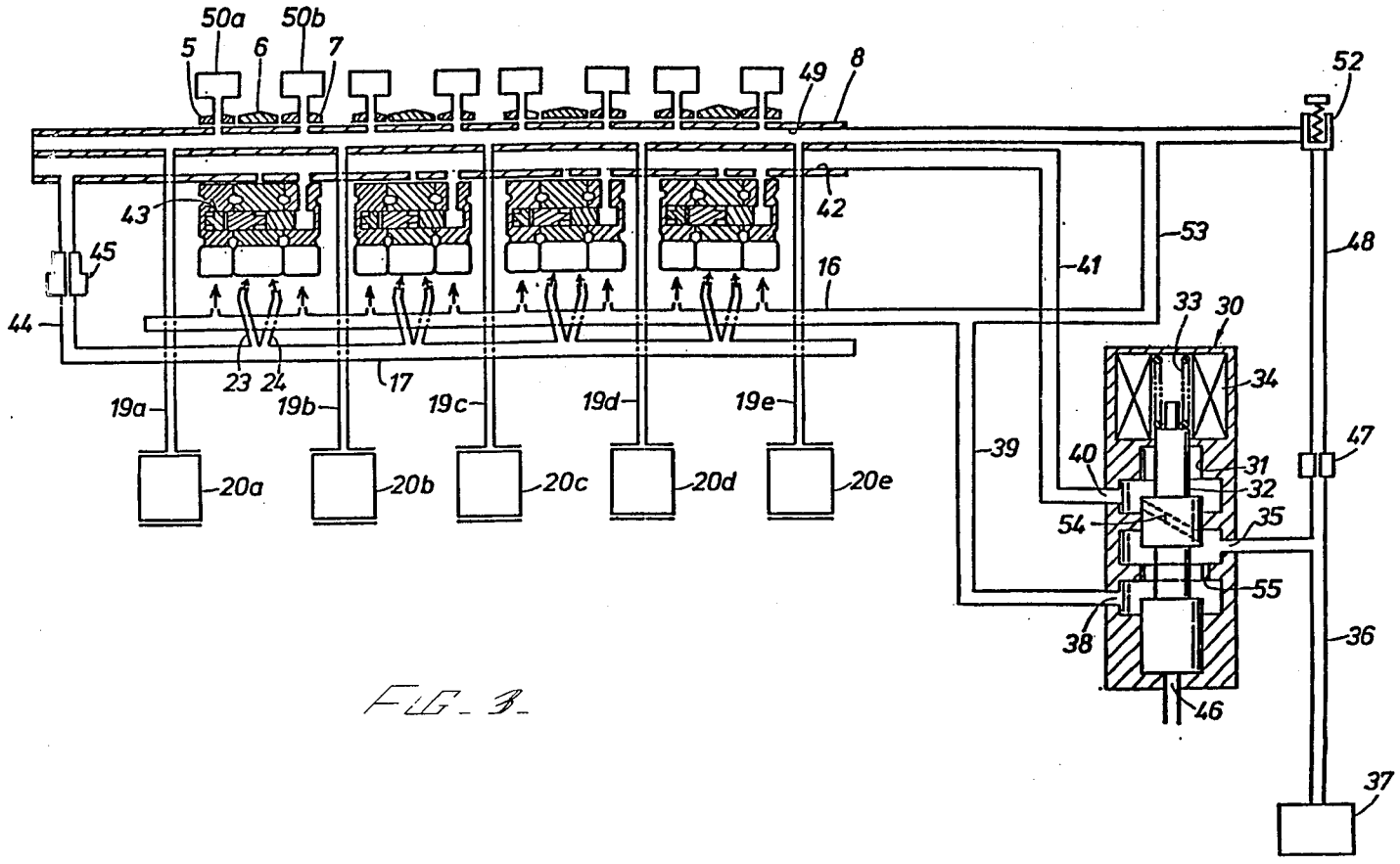
FIG. 3 is a diagram of a second embodiment of the hydraulic circuit of the present invention.

In the second embodiment as shown in FIG. 3, the relief valve 52 is located between oil passage 48 and oil passage 49. Downstream of the relief valve 52 is connected the oil passage 53 which leads to the oil passage 16. In all other respects this second embodiment is the same as the first embodiment. Thus, part of the lubricating oil supplied under pressure from the oil pump 37 through the oil passage 36 flows through the oil passage 48 while its flow rate is regulated by the orifice 47. After the pressure of the lubricating oil has been adjusted to a constant level by the relief valve 52, the lubricating oil is supplied the hydraulic lash adjusters 50*a*, 50*b*. Part of the lubricating oil flowing out of the relief valve 52 flows into the oil passage 53 and is combined with the lubricating oil supplied from the oil passage 39. The combined lubricating oil then flows into the oil passage 16 to lubricate the low-speed cams 5, 7.

With this second embodiment of the present invention, the relief valve is disposed in the oil passage leading from the engine to the hydraulic lash adjusters in the low-speed rocker arms for controlling the pressure of working oil, and the oil passage is branched off into communication with the oil feed passage for the low-speed cams downstream of the relief valve. Therefore, the hydraulic lash adjusters are stabilized in operation, and the low-speed cams can be supplied with sufficient oil even during high-speed operation of the engine. The operation of the valve operation timing control device is thus stabilized and made durable. Since the hydraulic circuit is relatively simple in arrangement, it can easily be assembled and maintained. The hydraulic circuit can effectively utilize lubricating oil retained in the engine for use as a sufficient supply of oil pressure for various oil feed systems.

Figure 4:
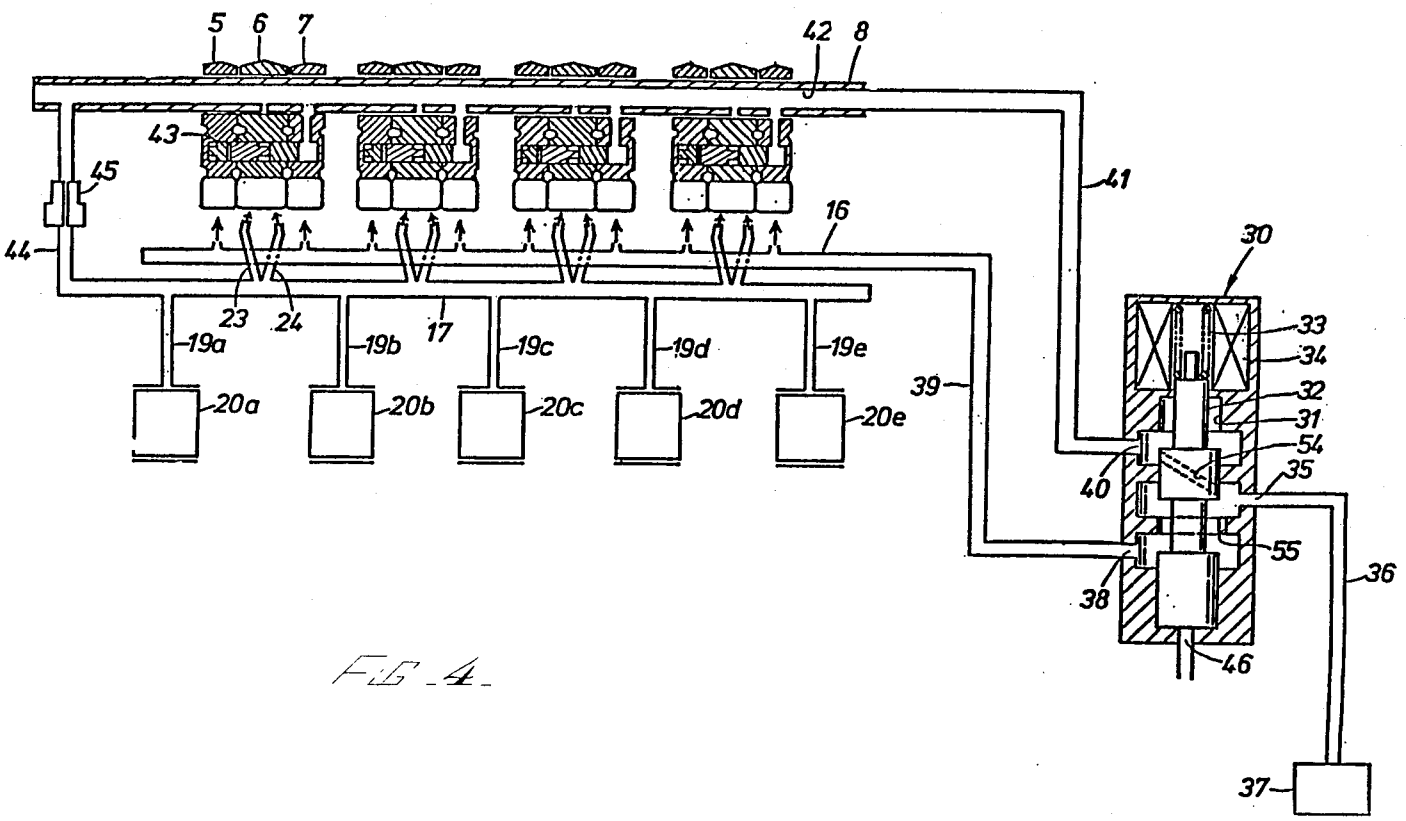
FIG. 4 is a diagram of a third embodiment of the hydraulic circuit of the present invention.

The third embodiment of this invention as shown in FIG. 4 is a substantially simplified form of the hydraulic circuits shown in FIGS. 2 and 3 for operating the valve operation timing mechanism and lubricating the various components requiring lubrication. No hydraulic lash adjusters are shown in this embodiment but they can be provided with a separate control system or mechanical adjusters can be provided. Again the solenoid valve 30 has an inlet port 35 connected to oil pump 37 by oil passage 36 and outlet ports 38 and 40 connected by oil passages 39 and 41, respectively, to oil passages 16 and 42, respectively. Oil passage 42 is connected through orifice 45 to oil passage 44 leading to oil passage 17. Thus, as described with respect to this portion of the first embodiment shown in FIG. 2, oil is constantly provided to oil passages 16 and 17 for lubricating all the cams and cam follower slippers, although the oil pressure is higher in one oil passage 16 or 17 than the other depending on the position of valve 30, and high pressure oil is supplied to oil passage 42 during high-speed engine operation for actuating the coupling devices 43 for coupling the respective cam followers 5, 6 and 7 together. This embodiment has similar advantages.

We claim:

1. A hydraulic circuit for a valve operation timing control device for an internal combustion engine, wherein oil pressure is applied from one end of an oil passage defined in a rocker shaft on which a rocker arm is pivotally supported, said oil passage extending to an actuator disposed in said rocker arm for opening an intake valve or an exhaust valve which is angularly movable by a cam on a camshaft rotatable in synchronism with a crankshaft and normally urged in a valve closing direction, an improvement comprising, said oil passage having a second end remote from said one end, and said second end communicating with an open end through an orifice to discharge oil for engine lubrication purposes.

2. A hydraulic circuit according to claim 1, wherein said open end comprises an oil feed passage for lubricating a component of the valve operation timing control device.

3. A hydraulic circuit according to claim 2, wherein said component is said cam.

4. A hydraulic circuit according to claim 2, wherein said component is said camshaft.

5. A hydraulic circuit according to claim 2, wherein said component is said rocker arm.

6. A hydraulic circuit according to claim 2, wherein said component is said cam, camshaft and rocker arm.

7. A hydraulic circuit according to claim 1, wherein said rocker arm has a hydraulic lash adjuster, and a relief valve is disposed in a second oil passage for supplying oil pressure from an oil pressure source to said hydraulic lash adjuster for controlling the oil pressure on the lash adjuster.

8. A hydraulic circuit according to claim 7, wherein a third oil passage supplies lubricating oil to said cam, and the relief valve has an outlet communicating with at least one of the first or third oil passages.

9. A hydraulic circuit for a valve operation timing control device for an internal combustion engine, comprising, a low-speed cam having a shape suited for low-speed operation of the engine, a high-speed cam having a shape suited for high-speed operation of the engine, the low- and high-speed cams being integrally formed on a camshaft rotatable in synchronism with a crankshaft, a first rocker arm held in slidable contact with said low-speed cam, a second rocker arm held in slidable contact with said high-speed cam, said first and second rocker arms being adjacent and in slidable contact with each other and pivotally supported on a rocker shaft for relative angular displacement, a first oil feed passage for lubricating said low-speed cam, and a second oil feed passage for lubricating said high-speed cam, said first rocker arm having hydraulic lash adjusters, a relief valve disposed in a separate oil passage for supplying oil pressure to said hydraulic lash adjuster, said relief valve having an outlet communicating with at least one of said first and second oil feed passages.

10. A hydraulic circuit according the claim 9, wherein said outlet of the relief valve communicates with only said first oil feed passage.

11. A hydraulic circuit according to claim 9, wherein said outlet of the relief valve communicates with only said second oil feed passage.

12. A hydraulic circuit according to claim 9, wherein said outlet of the relief valve communicates with both said first and second oil feed passages.

13. A hydraulic circuit according to claim 9, wherein said separate oil passage communicates with said first oil feed passage downstream of said relief valve.

14. A hydraulic circuit according to claim 9, wherein an oil flow restricting means is provided in said separate oil passage upstream of said relief valve.

15. A hydraulic circuit according to claim 9, wherein said relief valve causes a constant oil pressure to be supplied to said lash adjuster.

16. A hydraulic circuit for a valve operation timing control device for an internal combustion engine, comprising, a low-speed cam having a shape suited for low-speed operation of the engine, a high-speed cam having a shape suited for high-speed operation of the engine, the low- and high-speed cams being integrally formed on a camshaft rotatable in synchronism with a crankshaft, a first rocker arm held in slidable contact with said low-speed cam, a second rocker arm held in slidable contact with said high-speed cam, said first and second rocker arms being adjacent and in slidable contact with each other and pivotably supported on a rocker shaft for relative angular displacement, a hydraulically operated means for connecting said first and second rocker arms to pivot in unison, a first oil feed passage for lubricating said low-speed cam, and a second oil feed passage for lubricating said high-speed cam, a third oil passage for supplying high pressure oil for operating said hydraulically operated means, said third oil passage having a downstream end connected through a restriction means to said second oil feed passage

17. A hydraulic circuit according to claim 16, wherein said first rocker arm has a hydraulic lash adjuster, a relief valve is disposed in a separate oil passage for supplying oil pressure from the engine to said hydraulic lash adjuster, said oil passage communicates with said first oil feed passage downstream of said relief valve.

* * * * *